US007516571B2

(12) United States Patent
Scrogin et al.

(10) Patent No.: US 7,516,571 B2
(45) Date of Patent: Apr. 14, 2009

(54) INFRARED RANGE-FINDING AND COMPENSATING SCOPE FOR USE WITH A PROJECTILE FIRING DEVICE

(76) Inventors: Andrew D. Scrogin, 1221 Sixth St., Suite 312, Traverse City, MI (US) 49684; Walter E. Chapelle, 2168 E. Timberlane Dr., Traverse City, MI (US) 49686

( * ) Notice: Subject to any disclaimer, the term of this patent is extended or adjusted under 35 U.S.C. 154(b) by 365 days.

(21) Appl. No.: 10/845,017

(22) Filed: May 12, 2004

(65) Prior Publication Data

US 2005/0252062 A1 Nov. 17, 2005

(51) Int. Cl.
*F41G 1/00* (2006.01)

(52) U.S. Cl. ..... 42/114; 42/122

(58) Field of Classification Search ..... 42/114, 42/122, 113, 111; 89/41.17, 41.19
See application file for complete search history.

(56) References Cited

U.S. PATENT DOCUMENTS

| | | | | |
|---|---|---|---|---|
| 3,464,770 | A | 9/1969 | Schmidt | |
| 3,533,696 | A * | 10/1970 | De Winter | 356/5.06 |
| 4,695,161 | A | 9/1987 | Reed | |
| 4,965,439 | A | 10/1990 | Moore | |
| 5,026,158 | A * | 6/1991 | Golubic | 356/252 |
| 5,375,072 | A | 12/1994 | Cohen | |
| 5,491,546 | A | 2/1996 | Wascher et al. | |
| 5,669,174 | A * | 9/1997 | Teetzel | 42/115 |
| 5,771,623 | A | 6/1998 | Pernstich et al. | |
| 5,903,996 | A | 5/1999 | Morley | |
| 5,926,259 | A * | 7/1999 | Bamberger et al. | 356/5.01 |
| 6,132,048 | A * | 10/2000 | Gao et al. | 353/20 |
| 6,247,259 | B1 * | 6/2001 | Tsadka et al. | 42/114 |
| 6,252,706 | B1 * | 6/2001 | Kaladgew | 359/399 |
| 6,269,581 | B1 | 8/2001 | Groh | |
| 6,516,699 | B2 | 2/2003 | Sammut et al. | |
| 2003/0010190 | A1 | 1/2003 | Sammut et al. | |
| 2006/0048432 | A1 * | 3/2006 | Staley, III | 42/122 |

OTHER PUBLICATIONS

Range Finder, Laser Rangefinder (http://www.electronics-manufacturers.com/info/cameras-and-optics/range-finder-laser-rangefinder.html).*

* cited by examiner

*Primary Examiner*—Michelle Clement
(74) *Attorney, Agent, or Firm*—Douglas S. Bishop

(57) ABSTRACT

A scope assembly for use with a projectile firing device including an erect image telescope mounted upon the device. The telescope includes a housing with a series of spaced apart lenses, a reticle display field being disposed along an optical path established within the telescope and which is viewable by a user. A laser range-finding scope is housed within a component in parallel disposed fashion relative to the erect image telescope, the range-finding scope incorporating a microprocessor and timer in operative communication with a pulse generator and an infrared projector. The distance to the target is measured by the laser, pulse detector, and timer. The data is transmitted to the microprocessor which determines the vertical position required to hit the target. The compensated target aimpoint is then illuminated in the reticle display field as a horizontal line.

26 Claims, 6 Drawing Sheets

110

Vo = 2800 fps
BC = 0.501
Altitude= Sea Level

| V Range | n = 2-m | A |
|---|---|---|
| >2600 | 0.45 | 4.065E-03 |
| 2600-1800 | 0.3 | 1.248E-03 |
| 1800-1370 | 0 | 1.316E-04 |

| R (yards) | V (114) | t (116) | Drop (in) (120) | Lift (in) (122) | Net Drop (inches) (118) | Wind Drift (in/mph) (124) |
|---|---|---|---|---|---|---|
| 0 | 2800.0 | 0.000 | 0.00 | -1.50 | -1.50 | 0.00 |
| 50 | 2705.1 | 0.0545 | 0.57 | 1.31 | 0.74 | 0.02 |
| 100 | 2612.1 | 0.1109 | 2.32 | 4.12 | 1.80 | 0.07 |
| 106.545 | 2600.0 | 0.1185 | 2.64 | 4.49 | 1.85 | 0.08 |
| 150 | 2521.1 | 0.1692 | 5.34 | 6.93 | 1.60 | 0.15 |
| 200 | 2432.3 | 0.2300 | 9.74 | 9.74 | 0.00 | 0.28 |
| 250 | 2345.8 | 0.2928 | 15.61 | 12.55 | -3.05 | 0.44 |
| 300 | 2261.4 | 0.3579 | 23.04 | 15.37 | -7.68 | 0.64 |
| 350 | 2179.2 | 0.4255 | 32.18 | 18.18 | -14.00 | 0.89 |
| 400 | 2099.1 | 0.4956 | 43.14 | 20.99 | -22.15 | 1.18 |
| 450 | 2021.1 | 0.5684 | 56.06 | 23.80 | -32.26 | 1.52 |
| 500 | 1945.2 | 0.6441 | 71.10 | 26.61 | -44.49 | 1.91 |
| 600 | 1799.3 | 0.8045 | 108.08 | 32.23 | -75.84 | 2.84 |
| 700 | 1661.2 | 0.9780 | 155.57 | 37.85 | -117.71 | 4.01 |
| 800 | 1530.8 | 1.1661 | 215.33 | 43.48 | -171.86 | 5.44 |
| 900 | 1407.7 | 1.3705 | 289.51 | 49.10 | -240.41 | 7.15 |
| 1000 | 1291.7 | 1.5930 | 380.72 | 54.72 | -326.00 | 9.18 |

FIG - 6

128 126 130

Vo = 2800 fps
BC = 0.501
Altitude= Sea Level

| | Net Drop (inches) | | | 10 MPH Windage(inches) | | |
|---|---|---|---|---|---|---|
| R | Calculated | Published | Error | Calculated | Published | Error |
| 0 | -1.50 | -1.50 | 0.00 | 0.00 | 0.00 | 0.00 |
| 50 | 0.74 | 0.73 | 0.01 | 0.16 | 0.16 | 0.00 |
| 100 | 1.80 | 1.78 | 0.02 | 0.67 | 0.64 | 0.03 |
| 200 | 0.00 | 0.00 | 0.00 | 2.76 | 2.64 | 0.12 |
| 300 | -7.68 | -7.60 | -0.08 | 6.42 | 6.14 | 0.28 |
| 400 | -22.15 | -21.89 | -0.26 | 11.80 | 11.30 | 0.50 |
| 500 | -44.49 | -43.92 | -0.57 | 19.07 | 18.30 | 0.77 |
| 600 | -75.84 | -74.94 | -0.90 | 28.44 | 27.35 | 1.09 |
| 1000 | -326.00 | -323.84 | -2.16 | 91.80 | 88.57 | 3.23 |

FIG - 7

INFRARED RANGE-FINDING AND COMPENSATING SCOPE FOR USE WITH A PROJECTILE FIRING DEVICE

BACKGROUND OF THE INVENTION

1. Field of the Invention

The present invention relates generally to compensating devices for use with such as a gun or rifle scope. More specifically, the present invention teaches a combined riflescope and laser rangefinder device incorporating a microprocessor control for establishing a gravitational drop compensation factor for a given projectile trajectory and distance.

2. Description of the Prior Art

The prior art is well documented with gun and rifle scope assemblies, a significant function of which is the combined magnification and targeting of an object (i.e., bull's-eye target, hunting prey, etc.). Moreover, a number of such gun and rifle scope assemblies incorporate a form of range compensating mechanism, such addressing in particular bullet drop over a given trajectory.

U.S. Pat. No. 6,269,581, issued to Groh, teaches a range compensating rifle scope which utilizes laser range-finding and microprocessor technology and in order to compensate for bullet drop over a given trajectory range. The scope includes a laser rangefinder which calculates the distance between the user and the target that is focused in the scope crosshairs. A user enters a muzzle velocity value together with input for bullet weight and altitude, following which the microprocessor calculates a distance that the bullet traveling at the dialed-in speed will drop while traversing the distance calculated by the laser rangefinder, taking into consideration reduced drag at higher altitudes and the weight of the bullet. Based upon this calculated value, a second LCD image crosshair is superimposed in the scope's viewfinder, indicating the proper position at which to aim the rifle in order to achieve a direct hit.

U.S. Pat. No. 4,695,161, issued to Reed, teaches an autoranging sight including an optical view exhibiting an LC display reticle and having a plurality of horizontal lines which can be individually selected to be visible. A distance measuring device is provided for measuring distance from the sight to a target. Parameter information is input to a microprocessor to describe the flight of a projectile, the microprocessor also receiving distance information and then determining a required elevation for the optical viewer and attached weapon. The microprocessor selects one of the horizontal lines as the visible horizontal crosshair, upon which the operator then aligns the horizontal and vertical crosshairs seen through the view such that the projectile can be accurately directed to the target. A group of LCD vertical lines can be provided to accommodate windage adjustment for aiming the target. The range determination can be provided by systems using radar, laser, ultrasonic or infrared signals.

U.S. Pat. No. 6,252,706, issued to Kaladgew, teaches a telescopic sight for an individual weapon with automatic aiming and adjustment and which incorporates at least one step micro-motor designed for varying the angle of the sight relative to the axis of the weapon and the initial axis of aim. In this fashion, the whole sight assembly may be varied, thus also varying the original position of the sight reticle from the original point of aim to the required point of aim.

U.S. Pat. No. 5,771,623, issued to Pernstitch et al., teaches a telescopic sight for firearms having a laser rangefinder for the target with a laser transmitter and a laser receiver. Since the beam path of the laser transmitter and the beam path of the laser receiver are brought into the visual telescopic sight beam path, the telescopic sight objective is simultaneously the objective for the laser transmitter and the laser receiver. For adjusting the reticle on the point of impact an optical member is movable relative to the weapon and provided between the reticle and the light entrance side of the telescopic sight.

Finally, U.S. Pat. No. 5,669,174, issued to Teetzel, teaches a laser rangefinder that is modular so that it can be mounted upon different weapon platforms. A pulsed infrared laser beam is reflected off a target and a timed return signal utilized to measure the distance. Another laser, either a visible laser or another infrared laser of differing frequency, is used to place a spot on the intended target. Notch pass optical filters serve to eliminate ambient light interference from the second laser and the range finder uses projectile information stored in the unit to calculate a distance to raise or lower the finger on the weapon.

SUMMARY OF THE PRESENT INVENTION

The present invention is an improved laser rangefinder and sight. compensating device for use with such as a riflescope. The present invention is further an improvement over prior art imaging and range-finding displays in that it provides increased detail in a display field projected at a given location upon a scope reticle.

The scope assembly for use with the projectile firing device includes an erect image telescope mounted upon an axially extending surface associated with the projectile firing device. The telescope includes an elongate housing with a series of spaced apart lenses disposed between an eyepiece and an opposite objective lens. A reticle display field is projected upon a prism established along an optical path established within the telescope and which is viewable by a user through the eyepiece.

A laser range-finding scope is housed within a component in parallel disposed fashion relative to the erect image telescope, the range-finding scope incorporating a microprocessor and timer control circuit in operative communication with a pulse generator. The microprocessor may further be inputted by a serial interface alone or in communication with a date EEPROM unit and outputs a signal to a display driver.

A target distance is measured by a laser, pulse detector and timer. A switch in operative communication with the microprocessor initiates the timer control circuit and pulse generating functions. The data is transmitted to the microprocessor which determines the vertical position required to hit the target. A compensated target aimpoint is then illuminated in a reticle display field within an associated gun sight prism as a horizontal line.

BRIEF DESCRIPTION OF THE DRAWINGS

Reference will now be made to the attached drawings, when read in combination with the following detailed description, wherein like reference numerals refer to like parts throughout the several views, and in which:

FIG. 6 is an illustration of a set of ballistic data, dependant upon range and including parameters such as velocity, time, drop, wind drift, etc., associated with a specific variety of bullet and such as which is capable of being downloaded to the scope assembly of the present invention; and FIG. 7 is an illustration of a tabular comparison of net bullet drop values derived from the data set forth in FIG. 6, compensated further by a wind drift for a 10 mile/hour crosswind to a published table for a 0-1000 yard range.

DETAILED DESCRIPTION OF THE PREFERRED EMBODIMENTS

Figure 1:
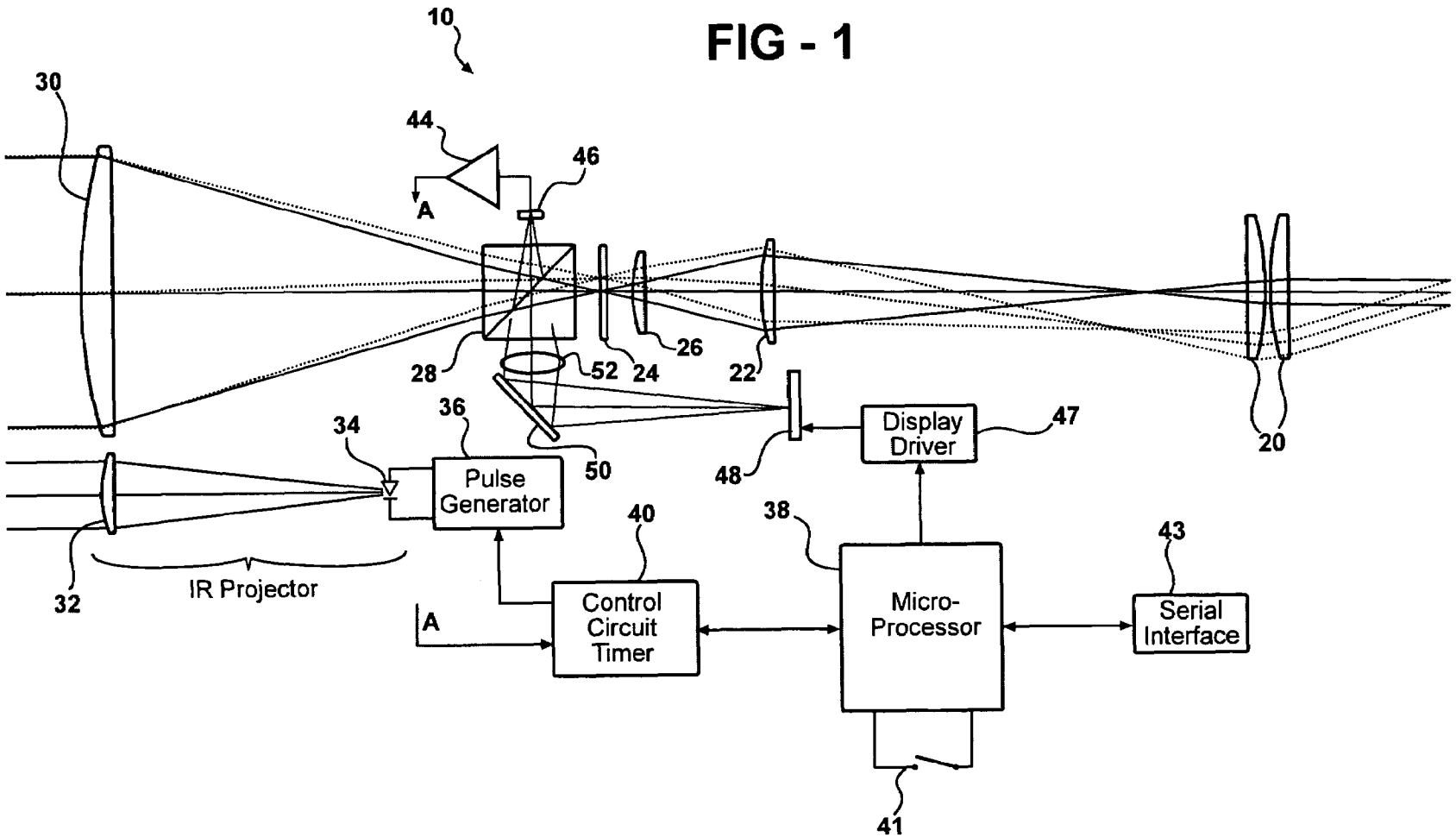
FIG. 1 is a diagrammatic view of an infrared range-finding and compensating scheme incorporated into a scope assembly according to a first preferred embodiment of the present invention.
Figure 2:
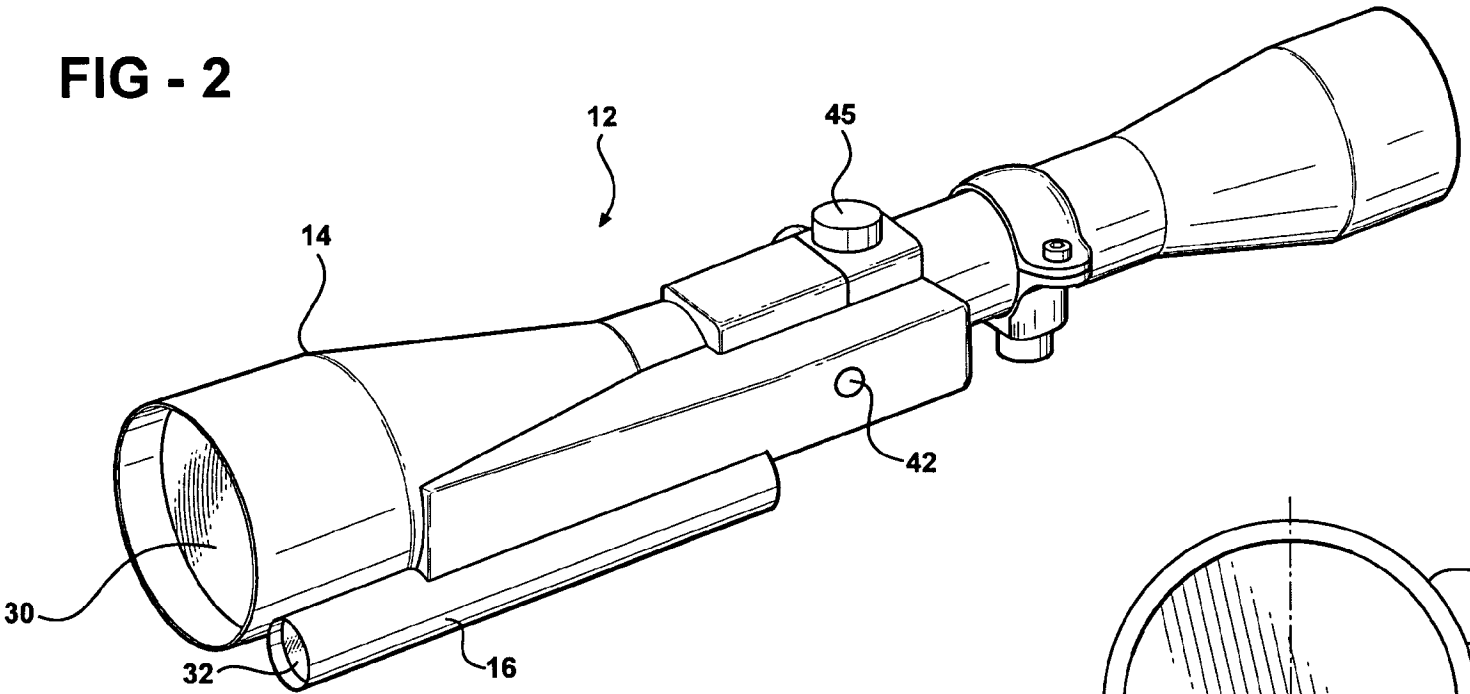
FIG. 2 is a perspective illustration of a scope construction according to the present invention and incorporating both a main sighting assembly as well as a communicating infrared projecting and range-finding subassembly.
Figure 2A:
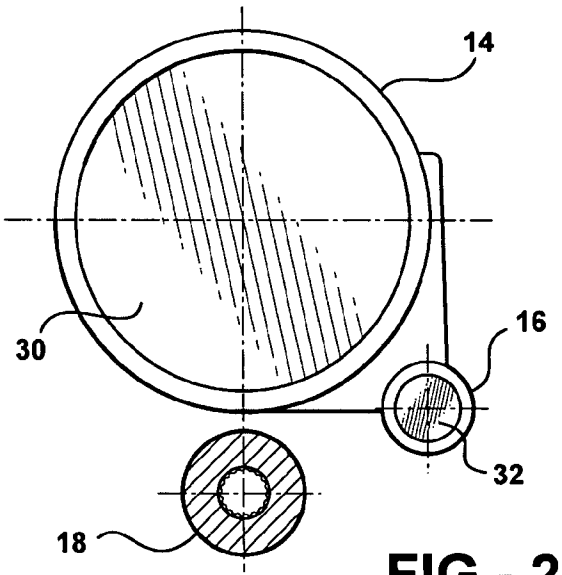
FIG. 2A is an end view of the scope construction illustrated in FIG. 2.

Referring now to FIG. 1, a diagrammatic view is illustrated at 10 of an infrared range-finding and compensating scheme incorporated into a scope assembly according to a first preferred embodiment of the present invention. Referring further to FIGS. 2 and 2A, both perspective and end view illustrations are shown at 12 of a scope construction incorporating the scheme 10 and in particular which incorporate both a main sighting assembly 14 as well as a communicating infrared projecting and range-finding subassembly 16.

In a preferred application, the scope construction 12 is provided as a riflescope assembly mounted in parallel aligning fashion with an axially extending upper surface of a rifle (see further barrel 18 in end view of FIG. 2A). The riflescope 12 is typically an erect image telescope, typically with a 5-20× magnification.

Typical scopes consist of objective, reticle, field erector and eyepiece components. The erect image telescope 12, as best illustrated again in reference to the schematic illustration of FIG. 1, further includes a pair of eyepiece lenses 20, and intermediately disposed erector lens 22 (either fixed or zoom), a reticle 24 and field lens 26 disposed between the erector lens 22 and dichroic (or other mono or multi-colored) prism 28, and an objective lens 30. The dichroic prism is added to perform the dual function of tapping off the infrared light to the detector and bringing the light from the display into the optical field. In a preferred application the objective lens 30 (see also FIG. 2) exhibits a first diameter in a range of 30-50 mm, the laser range-finding scope 16 including a collimating lens 32 in substantially collinear position relative to the objective lens 30 and exhibiting a second diameter in a range of 8-12 mm.

As is also known in the relevant art, the riflescope 12 is normally tilted downwardly slightly with respect to the axis of the rifle barrel and in order to compensate for the gravitational drop of the bullet. However, and since the bullet trajectory is similar to a parabolic curve, the compensation by riflescope alignment can only equal the bullet drop at the "zero range" which is typically set at approximately 200 yards for hunting purposes. The aiming point is further capable of being raised or lowered depending upon estimated target distances and, for long-distance targets where the bullet drops more rapidly, it become necessary to accurately measure the range and establish available means for adjusting the aiming point.

The range-finding component 16 is, as illustrated in FIGS. 1 and 2, in the preferred embodiment a near infrared projector consisting of a laser diode 34 in communication with the collimating lens 32, again mounted in adjacent fashion relative to the objective lens 30 of the erect image telescope 12 and which can produce a small spot of light at a range of 1000 yards or more. As best shown in FIG. 1, a pulse generator 36 operates the laser diode 34 and is in communication with a microprocessor 38 by means of an interdisposed timer control circuit 40.

The microprocessor 38 is activated upon closing a switch 41, also referenced by pushbutton 42 located upon the riflescope housing 12 in FIG. 2, to engage the timer control circuit 40 and pulse generator 36. It is also envisioned that a suitable switch or pushbutton can be located upon a forestock portion associated with the projectile firing device (rifle) or other user accessible location within the ordinary skill of one in the relevant art. Following the steps of laser projection, detection and timer measurement, information is inputted to the microprocessor. A serial interface 43 is also in operative communication with the microprocessor 38 and which permits the downloading of external bullet trajectory data, such as will be subsequently described in reference to FIGS. 6 and 7, for access by the microprocessor. Following the above steps, the calculated drop values are displayed in a corrected aimpoint line.

An amplifier 44 is in operative communication at one end with an infrared detector 46, located in proximity to the prism 28, as well as communicating with the timer control circuit 40. The infrared detector 46 is constructed such that it is capable of being illuminated through the objective lens 30, thus offering the advantage of a relatively large lens for the IR detector to "see through". It is further assumed that provision is made for both the IR laser projector and IR detector to be "zeroed" in relationship to the mechanical reticle 24. The pulse generator 36 and control circuit 40 progress through a number of iterations until a constant time delay value is obtained and which is indicative of a valid range measurement. It is further envisioned that the narrow center section of the riflescope 12 will provide the necessary space for mounting the electronic circuitry, as well as the portable power supply. Alternatively, it is envisioned that a foldout electronics package associated with the riflescope may be necessary.

Upon communicating this information to the microprocessor, an output thereof is communicated to a display driver 47 and which is in turn communicated to a light emitting display 48. The display 48 is selected from such as an organic light emitting display (OLED), a standard light emitting diode display, a liquid crystal display (LCD), or (as will be further described in reference to the embodiment of FIG. 4) a digital micro-mirror display. An angled mirror 50 redirects the generated and projected display 48, which is then passed through a display lens 52 and into the prism 28.

In combination with the infrared detector 46, a suitable targeting display image is projected upon the reticle display field. Referring to FIGS. 3A-3D, a variety of different targeting display lines are illustrated, generated upon the reticle crosshairs of the main scope by such as the organic light emitting diode (OLED) display and resultant from a corrected value derived and inputted from the infrared projecting/range-finding subassembly. The measured value is also used to compute a desired vertical shift which will be required to compensate for the gravitational effect on the bullet. This vertical shift is a function of the bullet weight and its direction. Since the direction becomes increasingly vertical (downward) as times goes by, the vertical deceleration component (upward) is subtracted from the gravitational component (downward), and the resulting aimpoint shift is then corrected for the aimpoint offset and displayed as a horizontal line. Again, the targeting display lines accounting for bullet trajectory (drop) based upon determined range as well as lateral compensating points determinant upon deflecting crosswind conditions.

The overall components of the invention, are set forth throughout this description in detail. In the preferred embodiment, optimum operation ideally consists of the following steps, in order: Switch 41 is closed; the laser diode 34 is fired; a pulse back is obtained in the infrared detector 46; the laser 34 is fired again at least once, to confirm an appropriate pulse back from the infrared detector 46; timer measurement of distance is obtained; input is provided to micro-processor 38; the drop correction is calculated from the stored data; the lift correction for that range is subtracted; and the result is displayed.

Figure 3A:
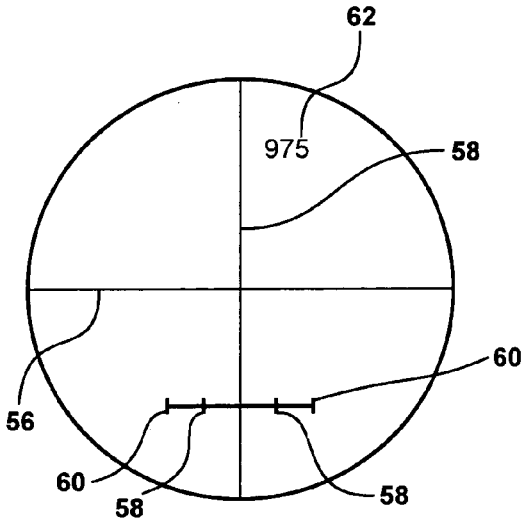
FIGS. 3A-3D illustrate a variety of different targeting display lines, generated upon the reticle crosshairs of the main scope, by the organic light emitting diode (OLED) display and resultant from a corrected value derived and inputted from the infrared projecting/range-finding subassembly, the targeting display lines accounting for bullet trajectory (drop) based upon determined range as well as lateral compensating points determinant upon deflecting crosswind conditions.

FIG. 3A illustrates at 54 a long distance configuration sight display line placed upon a reticle display field (see crosshairs 56 and 58) defined at a specified vertical position (such as relative vertical crosshair 58). The sight display line 54 is projected such as a red line upon a visual field (dichroic projection) and again defines a vertical shift in the aiming point and which is required by the user to compensate for the gravitational effects upon the bullet at a specified laser defined range. As is further evident, the display line 54 is elongated with spaced apart pairs of reference markings 57 and 60, this in turn defining left or right aiming point shifts required to compensate for 10 and 20 mile per hour wind velocity components normal to the trajectory pattern of the bullet. Also illustrated at 62 is a range marking (such as 975 yards) projected by the light emitting display as an additional image upon the reticle display field.

Figure 3B:
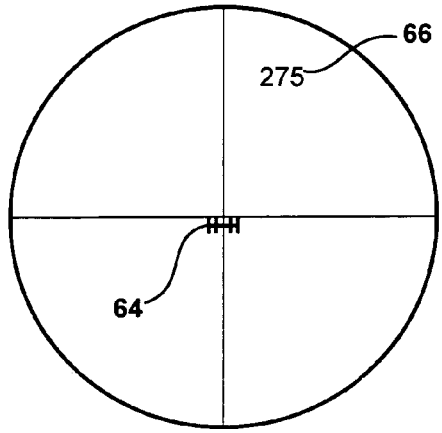
Figure 3C:
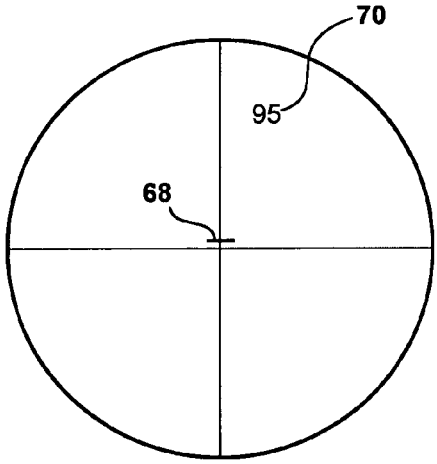

FIG. 3B illustrates a second example of a combination sight display line 64 exhibiting a further suitable set of crosswind adjustment markings and a range marking 66 (275 yards), and which corresponds generally with an intermediate range sighting configuration. FIG. 3C illustrates a yet further example of a sight line 68 and range marking 70 (95 yards) combination corresponding to a very short range sighting configuration. At ranges of less than 250 yards, the length of the horizontal line is frozen, and windage marks eliminated. Otherwise, the horizontal line and windage marks become too small to discern, as windage is relatively inconsequential at close range, in any event.

Figure 3D:
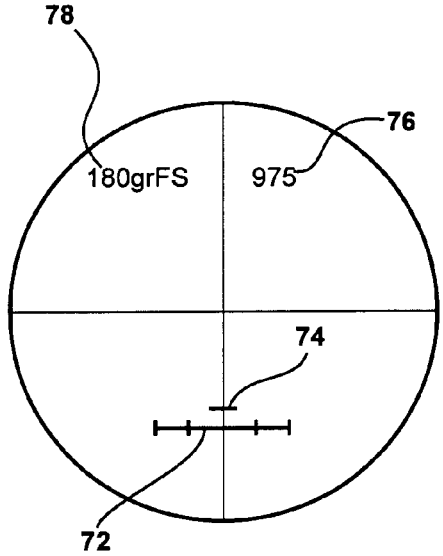

Finally, FIG. 3D illustrates a variation of a long range sighting display (see also FIG. 3A), such as again an OLED generated display, referenced by dichroic projected sight line 72 with cross wind markings. Also displayed in colored fashion (such as again red which contrasts best with the background viewed through the scope) is an added line 74 which indicates how far the aiming point needs to be shifted at the measured range if the rifle is aimed at a substantial up or down angle, such as 30 degrees in the illustrated example.

This optional display function is useful for hunting in terrain with steep slopes and where a hunter can estimate the slope at a given spot and make a reasonable correction. This option, along with an added switch on the forearm grip and data storage for multiple cartridges (see again pushbutton 44) can be used when hunting objectives are changed in the field. Also illustrated in FIG. 4D at 76 is a dichroic projection referencing the range determination (again 975 yards) and a further image may be projected at 78 representative of a cartridge (bullet) identification script.

Figure 4:
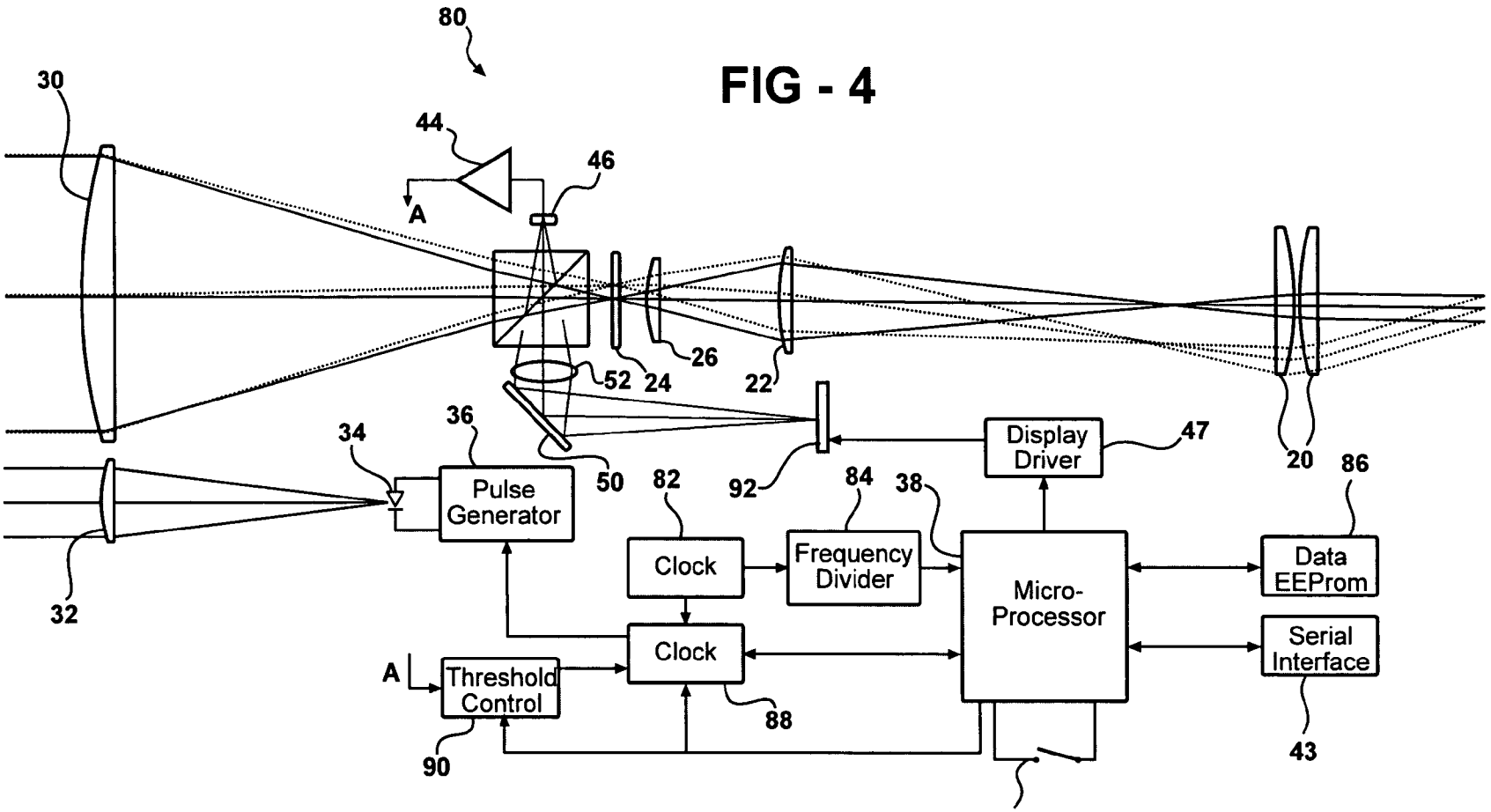
FIG. 4 is a diagrammatic view of a modified infrared range-finding and compensating scheme incorporated into a scope assembly according to a second preferred embodiment of the present invention and in which the microprocessor functions have been expanded to include the sequential functions of range-finding and aiming-point calculation.

Referring now to FIG. 4, a diagrammatic illustration is presented at 80 of a modified infrared range-finding and compensating scheme incorporated into a scope assembly according to a second preferred embodiment of the present invention. For purposes of ease of explanation, all features common to the schematic arrangement set forth in FIG. 1 are identically numbered and the present explanation and description will focus on those elements particular to this embodiment.

In particular, the microprocessor 38 operation in FIG. 4 has been expanded to include control the sequential functions of range-finding and aiming-point calculation. A common clock 82 simplifies internal data transfer to the microprocessor 38 and via a frequency divider component 84. For the range-finding operation, the microprocessor may be programmed to control the threshold level for the detector output and in order to reduce or eliminate noise from the timer output. The threshold setting can further be based on the noise level prior to the generation of each pulse and on the variation of sequential timer outputs.

The microprocessor functions have been expanded to include the sequential functions of range-finding and aiming-point calculation and an EEPROM unit 86 is provided in communication with the microprocessor 38 in order to provide memory for the storage of trajectory data and other range-finding and aiming-point parameters such as a "zero range" setting. Additional features include a timer 88 in an input communication relative the internal clock 82, as well as in sequential input/output communication with the microprocessor 38 and the pulse generator 36. The output from the microprocessor 38 to the timer 88 is further configured in parallel with a threshold control 90, which is in turn in communication with the infrared detector 46 and amplifier arrangement 44. Also, the organic light emitting (OLED) display 48 in FIG. 1 has been substituted by a digital micro-display 92 in FIG. 4.

Figure 4A:
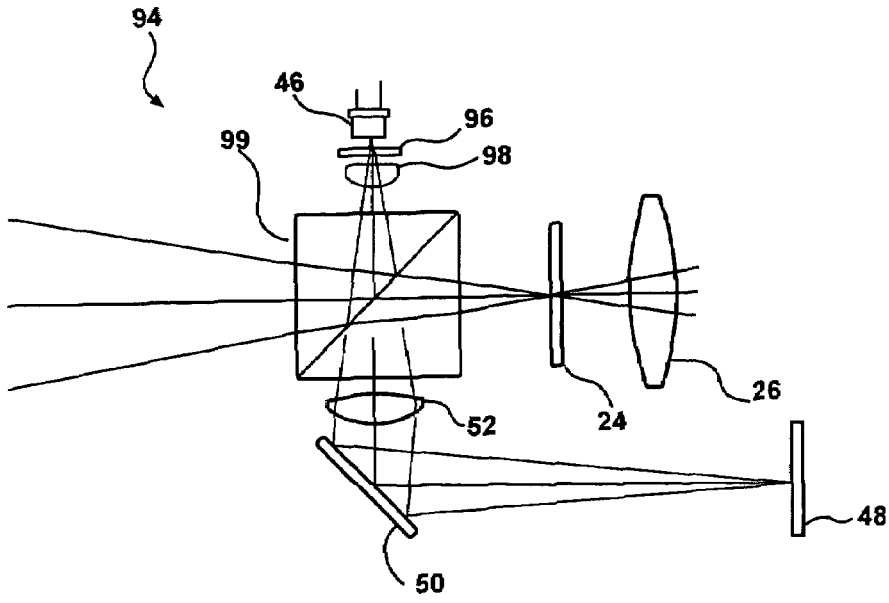
FIG. 4A is a sectional illustration of a modified prism portion to that shown in FIG. 4 and which has been modified by the addition of a narrow band filter and lens for focusing the IR onto the detector and in particular corrects for offset between the IR projector and the riflescope axis.

Referring now to FIG. 4A, a sectional illustration is shown at 94 of a modified prism, to that illustrated generally at 28 in FIGS. 1 and 4. Common elements again include OLED display 48, mirror 50, display lens 52, field lens 26, reticle 24, and infrared detector 46. The prism 94 is further modified by the addition of a narrow band filter 96 and condenser lens 98 for focusing the OLED image within a prism box 99, and in particular corrects for offset between the IR projector and the riflescope axis.

Figure 5:
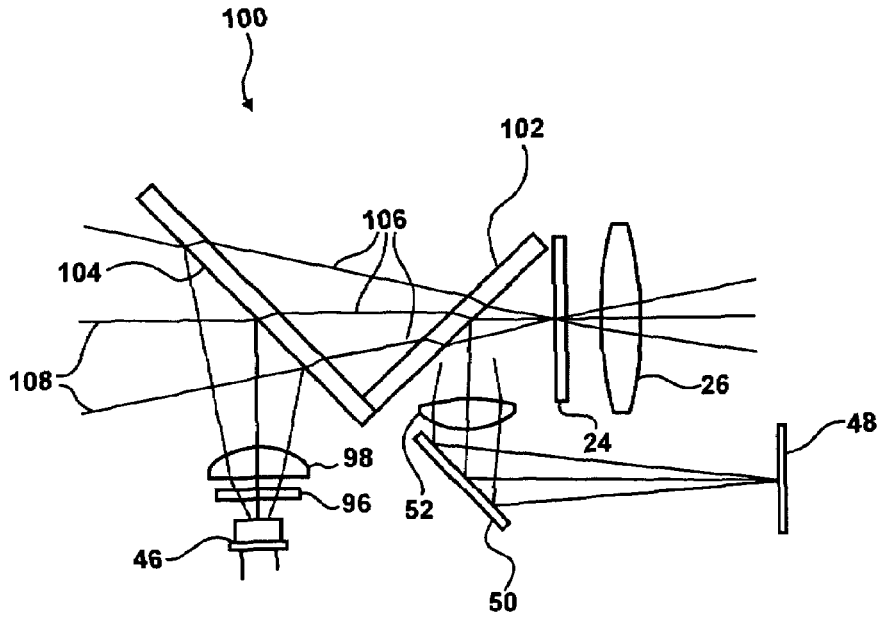
FIG. 5 is a further modified sectional illustration of a prism portion and by which the dichroic prism of FIG. 4A has been substituted by a pair of angularly offset and beam splitting mirrors, a first of which is coated to transmit visible wavelengths and to reflect the laser IR wavelength to the detector, and the second of which, in addition to transmitting visible light, partially reflects the micro-display color to provide contrast in a natural environment.

FIG. 5 illustrates at 100 a further modified sectional illustration of a prism arrangement and by which the dichroic (dual color projecting) prism of FIG. 4A has been substituted by a pair of angularly offset and beam splitting mirrors 102 and 104. The first mirror 102 is coated to transmit visible wavelengths, as illustrated at 106, and to reflect the laser IR wavelength (approximately 900 nanometers) to the detector. The second mirror 104, in addition to transmitting visible light (see at 108), partially reflects the micro-display color to provide contrast in a natural environment. By mounting the mirrors at a 90 degree angle to each other, the astigmatism produced by a tilted plane in convergent light is removed.

A computer-controlled aiming point display can also be performed with a transparent OLED placed in contact with the mechanical reticule, or the two disks can be combined. This removes the display lens. LCD have been used for reticle applications (Reed U.S. Pat. No. 4,695,161 and Groh U.S. Pat. No. 6,269,581), but a transparent OLED will be an improvement as a luminous reticle.

FIG. 6 is a tabular illustration at 110 of a set of ballistic data and which consists of such information which can be serial ported to the microprocessor, EEPROM and serial interface components of the invention. The tabular data consists of published data, typically provided by the ammunition manufacturers, and which is dependant upon range, see entries at 112, to which are listed corresponding parameters for such as velocity 114, time 116, bullet net drop 118 (resulting from the difference between drop 120 and lift 122 components), and wind drift 124. The data is compiled relative to a specific variety of bullet and such as which is capable of being downloaded to the scope assembly of the present invention.

Finally, FIG. 7 is an illustration at 126 of a tabular comparison of net bullet drop values 128 derived from the data set forth in FIG. 6, compensated further by entries 130 for wind drift of a 10 mile/hour crosswind to a published table for a 0-1000 yard range. As is known, wind deflection is a function of the transverse component of the air resistance with respect to the bullet's direction of travel, and is proportional to the crosswind velocity. However, and since the muzzle velocity and air resistance determine the travel time for a given range, they also define a wind deflection curve that is similar to the gravitational drop.

Accordingly, the laser rangefinder of the present invention provides simplified and more flexible applications for a corrected riflescope targeting. As such, a user can easily set up the scope system by purchasing the riflescope and a factory programmed trajectory dataset, mounting the scope upon the rifle, and zeroing the same in like any other riflescope. The user then proceeds to press a button disposed on the scope or rifle stock, aim with the corrected display image projected upon the scope crosshairs, and fire.

Having described our invention, other and additional preferred embodiments will become apparent to those skilled in the art to which it pertains and without deviating from the scope of the appended claims.

We claim:

1. A range compensating scope assembly, comprising:

an erect image telescope mounted upon an axially extending surface associated with a projectile firing device, said telescope including a housing with a series of spaced apart lenses, a reticle display field being disposed along an optical path established within said telescope and which is viewable by a user;

a laser range-finding scope housed within a component in parallel disposed fashion relative to said erect image telescope, said range-finding scope incorporating a microprocessor and timer in operative communication with a pulse generator, infrared laser projector, and a detector; and a microprocessor generated signal communicating to a prism located along said telescope optical path and, in combination with a display driver located in proximity to said prism and further including at least one mirror and a display lens located between said display driver and prism for projecting light and creating a new focal plane not situated between said spaced apart lenses, establishing a horizontally projected targeting display image upon said reticle display field representing a corrected aimpoint.

2. The scope assembly as described in claim 1, further comprising a switch in operative communication with said microprocessor for initiating said timer and pulse generating functions of said laser range-finding scope, an output of said microprocessor in operative communication with a display driver prior to being communicated to said prism.

3. The scope assembly as described in claim 2, further comprising a light emitting display for generating said display image and disposed between said display driver and said prism.

4. The scope assembly as described in claim 3, said display comprising at least one of an organic light emitting display, a standard light emitting diode display, and a digital micromirror display.

5. The scope assembly as described in claim 3, further comprising a serial interface in operative communication with said microprocessor, said interface permitting the downloading of external bullet trajectory data for access by said microprocessor.

6. The scope assembly as described in claim 5, further comprising an EEPROM unit in parallel communication with said microprocessor and relative said serial interface.

7. The scope assembly as described in claim 5, wherein the external bullet trajectory data permitted to be downloaded includes the net bullet drop and windage drift.

8. The scope assembly as described in claim 7, wherein the net bullet drop and windage drift included within the downloaded data is calculated using pre-determined velocity, ballistics coefficient, altitude, and ballistics constants.

9. The scope assembly as described in claim 8 wherein the velocity, ballistics coefficient, altitude, and ballistics constants may be modified by the operator.

10. The scope assembly as described in claim 1, said targeting display image further comprising an elongated horizontal component exhibiting reference markings each corresponding to a determined lateral compensation accounting for a detected crosswind condition.

11. The scope assembly as described in claim 1, said prism further comprising at least one angularly disposed and beam splitting mirror.

12. The scope assembly as described in claim 11, further comprising a pair of angularly offset and beam splitting mirrors, a first selected mirror being coated to transmit visible wavelengths and to reflect the laser IR wavelength to said infrared detector, a second selected mirror partially reflecting a micro-display color to provide contrast in a natural environment.

13. The scope assembly as described in claim 1, said prism further comprising a dichroic prism with the addition of a narrow band filter and lens for focusing an emitted image and in particular correcting for any offset between said range-finding scope and said erect image telescope.

14. The scope assembly as described in claim 13, said scope assembly having a specified shape and size and further comprising an elongated housing adapted for being secured atop a projectile firing device, said housing enclosing a portable power supply in operative communication with said laser range-finding scope.

15. The scope assembly as described in claim 14, further comprising a switch associated with at least one of an exterior location associated with said housing and a forestock associated with the projectile firing device, said switch initiating activation of said microprocessor, said pulse generator, and an interdisposed control timer.

16. The scope assembly as described in claim 14, said erect image telescope further comprising an eyepiece lens, an intermediately disposed erector lens, a reticle and field lens disposed between said erector lens and said dichroic prism, and an objective lens.

17. The scope assembly as described in claim 16, said objective lens exhibiting a first diameter in a range of 30-50 mm, said laser range-finding scope including a collimating lens in substantially collinear position relative to said objective lens and exhibiting a second diameter in a range of 8-12 mm.

18. The scope assembly as described in claim 3, further comprising a range, measured as a numerical value by said laser scope, being projected by said light emitting display as an additional image corresponding to said focal plane upon said reticle display field.

19. The scope assembly as described in claim 3, further comprising an angled mirror and display lens arrangement communicating said light emitting display with to a first location of said prism, and infrared filter and condenser lens arrangement communicating said infrared detector with a second location of said prism.

20. The scope assembly as described in claim 16, said erector lens further comprising a zoom lens.

21. The scope assembly as described in claim 18, further comprising a cartridge identification script projected by said light emitting display as an additional image upon said reticle display field.

22. The scope assembly as described in claim 21, further comprising a switch associated with at least one of an exterior location associated with said housing and a forestock associated with the projectile firing device, said switch being communicable with a data storage unit associated with said microprocessor for displaying information relative to additional types of projectile cartridge.

23. The scope assembly as described in claim 1, further comprising internal clock and frequency divider components in operative communication with said microprocessor.

24. A range compensating scope assembly, comprising:

an erect image telescope mounted upon an axially extending surface associated with a projectile firing device, said telescope including an elongate housing with a series of spaced apart lenses disposed between an eyepiece and an opposite objective lens, a reticle display field being projected upon a prism established along an optical path established within said telescope and which is viewable by a user;

a laser range-finding scope housed within a component in parallel disposed fashion relative to said erect image telescope, said range-finding scope incorporating a microprocessor and timer control circuit in operative communication with a pulse generator, said microprocessor outputting a signal to a display driver and further including at least one mirror and a display lens located between said display driver and prism for projecting light and creating a new focal plane not situated between said spaced apart lenses;

a switch in operative communication with said microprocessor for initiating said timer control circuit and pulse generating functions, said timer control circuit interfacing between said microprocessor and an output to said pulse generator, as well as interfacing between said microprocessor and an input from an infrared detector positioned at a selected communicating location with said prism; and a light emitting display for generating a display image disposed between said display driver and a further selected communicating location with said prism opposing that of said infrared detector.

25. The scope assembly as described in claim 18, further comprising a line demonstrating the amount of line of sight adjustment at the measured range for firing at a substantial up or down angle, projected by said light emitting display as said additional image upon said reticle display field.

26. A range compensating scope assembly, comprising:

an erect image telescope mounted upon an axially extending surface associated with a projectile firing device, said telescope including a housing with a series of spaced apart lenses, a reticle display field being disposed along an optical path established within said telescope and which is viewable by a user;

a laser range-finding scope housed within a component in parallel disposed fashion relative to said erect image telescope, said range-finding scope incorporating a microprocessor and timer in operative communication with a pulse generator, infrared laser projector, and a detector;

a microprocessor generated signal communicating to a prism located along said telescope optical path and, in combination with a display driver located in proximity to said prism and further including at least one mirror and a display lens located between said display driver and prism for projecting light and creating a new focal plane not situated between said spaced apart lenses, establishing a horizontally projected targeting display image upon said reticle display field representing a corrected aimpoint; and said microprocessor calculating both a range and said corrected aim point resulting from a common clock providing a simplified internal data transfer to said microprocessor via a frequency divider component, a serial interface communicating to said microprocessor at least one of range finding and aiming point calculation, an EEPROM unit being in separate communication with said microprocessor and providing memory for storing at least one of trajectory data, range-finding and aiming point parameters, said processor outputting said corrected aim point to another timer configured in parallel with a threshold control and in turn communicated to an IR detector and amplifier.

* * * * *